US012669310B1

(12) United States Patent
Pauze

(10) Patent No.: US 12,669,310 B1
(45) Date of Patent: Jun. 30, 2026

(54) SYSTEM, APPARATUS, AND METHOD FOR HOLDING EQUIPMENT

(71) Applicant: John Paul Pauze, Richmond, VA (US)

(72) Inventor: John Paul Pauze, Richmond, VA (US)

( * ) Notice: Subject to any disclaimer, the term of this patent is extended or adjusted under 35 U.S.C. 154(b) by 0 days.

(21) Appl. No.: 19/343,097

(22) Filed: Sep. 29, 2025

(51) Int. Cl.
*F41H 1/02* (2006.01)

(52) U.S. Cl.
CPC ..... *F41H 1/02* (2013.01)

(58) Field of Classification Search
CPC ..... F41H 1/02; F41H 5/08; A45F 3/06; A45F 2003/003; A45F 2004/023; A45F 3/047; A45F 4/02; A45F 3/02; A45C 9/00; A45C 2009/007; A45C 3/08
See application file for complete search history.

(56) References Cited

U.S. PATENT DOCUMENTS

| | | | | |
|---|---|---|---|---|
| 1,978,971 | A * | 10/1934 | Thornhill | A45C 3/06 150/105 |
| 5,829,653 | A | 11/1998 | Kaiser | |
| 6,029,723 | A * | 2/2000 | Baquero | A45C 13/30 150/105 |
| 6,179,025 | B1 * | 1/2001 | Sutton | A45C 13/02 383/18 |
| 6,685,071 | B2 | 2/2004 | Prather | |
| 7,441,278 | B2 | 10/2008 | Blakeley | |
| 8,123,093 | B2 * | 2/2012 | Merzon | A45F 5/02 224/259 |
| 10,051,945 | B1 | 8/2018 | Pomare | |
| 11,330,894 | B2 * | 5/2022 | Rushing | A45F 4/02 |
| 11,344,104 | B2 | 5/2022 | Miller | |
| 11,506,469 | B2 | 11/2022 | Lee | |
| 2002/0029831 | A1 * | 3/2002 | Pendergrass | A45C 3/06 150/105 |
| 2007/0295772 | A1 | 12/2007 | Woodmansee | |
| 2009/0180715 | A1 | 7/2009 | Wittke-Kothe | |
| 2010/0206930 | A1 * | 8/2010 | Sims | A63C 11/025 224/250 |

(Continued)

FOREIGN PATENT DOCUMENTS

| | | | | |
|---|---|---|---|---|
| CA | 3065610 C | * | 1/2021 | A45F 4/02 |
| EP | 3272245 | | 1/2018 | |

(Continued)

OTHER PUBLICATIONS

CA_3065610 with translation (Year: 2021).*

*Primary Examiner* — Adam J Waggenspack
(74) *Attorney, Agent, or Firm* — Keefe IP Law, PLLC

(57) ABSTRACT

A method for converting a wearable apparatus is disclosed. The method includes supporting a body member of the wearable apparatus from a shoulder of a user based on a shoulder connector of the wearable apparatus being directly attached to the body member and being supported at the shoulder of the user, and indirectly supporting a housing of the wearable apparatus based on removably attaching a housing cover of the housing to a housing body of the housing when the body member is received in a housing cavity of the housing body. The method also includes removing the housing from the wearable apparatus based on detaching the housing cover from the housing body, and moving the body member toward the shoulder of the user, when the shoulder connector is supported at the shoulder of the user, based on decreasing a length of the shoulder connector.

20 Claims, 9 Drawing Sheets

(56) References Cited

U.S. PATENT DOCUMENTS

| | | | | |
|---|---|---|---|---|
| 2012/0266344 | A1 | 10/2012 | Griffin | |
| 2017/0276457 | A1* | 9/2017 | Chapman | F41H 1/00 |
| 2020/0268468 | A1* | 8/2020 | Long | A61B 50/31 |
| 2021/0212426 | A1 | 7/2021 | Huang | |
| 2023/0085150 | A1 | 3/2023 | Uhm | |
| 2023/0130075 | A1 | 4/2023 | Shemwell | |

FOREIGN PATENT DOCUMENTS

| | | | | |
|---|---|---|---|---|
| GB | 2537412 | | 10/2016 | |
| GB | 2537412 | A * | 10/2016 | F42B 39/02 |

* cited by examiner

SYSTEM, APPARATUS, AND METHOD FOR HOLDING EQUIPMENT

TECHNICAL FIELD

The present disclosure generally relates to a system, apparatus, and method for equipment, and more particularly to a system, apparatus, and method for holding equipment.

BACKGROUND

Wearable accessories for holding equipment such as weapons and weapon-related items provide protection to their wearers by providing easy and quick access to such items for self-defense. Some of these wearable accessories are convertible, for example between an undeployed state such as a garment or bag to a deployed state that can aid in self-defense by the wearer.

Conventional convertible accessories for holding equipment such as weapons and weapon-related items are typically difficult to don and/or adjust once a user is wearing the accessory. For example, when a user is wearing such an accessory, it is usually difficult for the user to quickly and easily adjust the accessory when it is in a deployed state for self-defense.

Patent publication number US 2017/0276457 to Chapman (the '457 reference) provides one attempt to provide a convertible accessory for self-defense. The '457 reference discloses a backpack that can be converted into a ballistic shield based on the user performing a series of conversion steps.

However, the conversion process of the '457 reference is relatively cumbersome, involving the manipulation of straps of the accessory and rotating the accessory from the user's back to the user's front, as well as including as best understood an additional unfastening step to deploy the ballistic shield.

Accordingly, a need in the art exists for a convertible accessory that can be quickly and easily deployed from an undeployed state to a deployed state.

The exemplary disclosed system, apparatus, and method of the present disclosure are directed to overcoming one or more of the shortcomings set forth above and/or other deficiencies in existing technology.

SUMMARY OF THE DISCLOSURE

In one exemplary aspect, the present disclosure is directed to a method for converting a wearable apparatus. The method includes supporting a body member of the wearable apparatus from a shoulder of a user based on a shoulder connector of the wearable apparatus being directly attached to the body member and being supported at the shoulder of the user, and indirectly supporting a housing of the wearable apparatus based on removably attaching a housing cover of the housing to a housing body of the housing when the body member is received in a housing cavity of the housing body. The method also includes removing the housing from the wearable apparatus based on detaching the housing cover from the housing body, and moving the body member toward the shoulder of the user, when the shoulder connector is supported at the shoulder of the user, based on decreasing a length of the shoulder connector.

In another aspect, the present disclosure is directed to a wearable apparatus. The wearable apparatus includes a body member, a shoulder connector directly attachable to the body member, the shoulder connector configured to be supported at a shoulder of a user, and a housing including a housing body, which forms a housing cavity, and a housing cover, the housing configured to be indirectly supported by the body member based on removably attaching the housing cover to the housing body when the body member is received in the housing cavity, the housing being configured to be removed from the wearable apparatus based on detaching the housing cover from the housing body. The shoulder connector includes a quick adjustment device configured to decrease a length of the shoulder connector and move the body member toward the shoulder of the user when the shoulder connector is supported at the shoulder of the user.

DETAILED DESCRIPTION AND INDUSTRIAL APPLICABILITY

Figure 1:
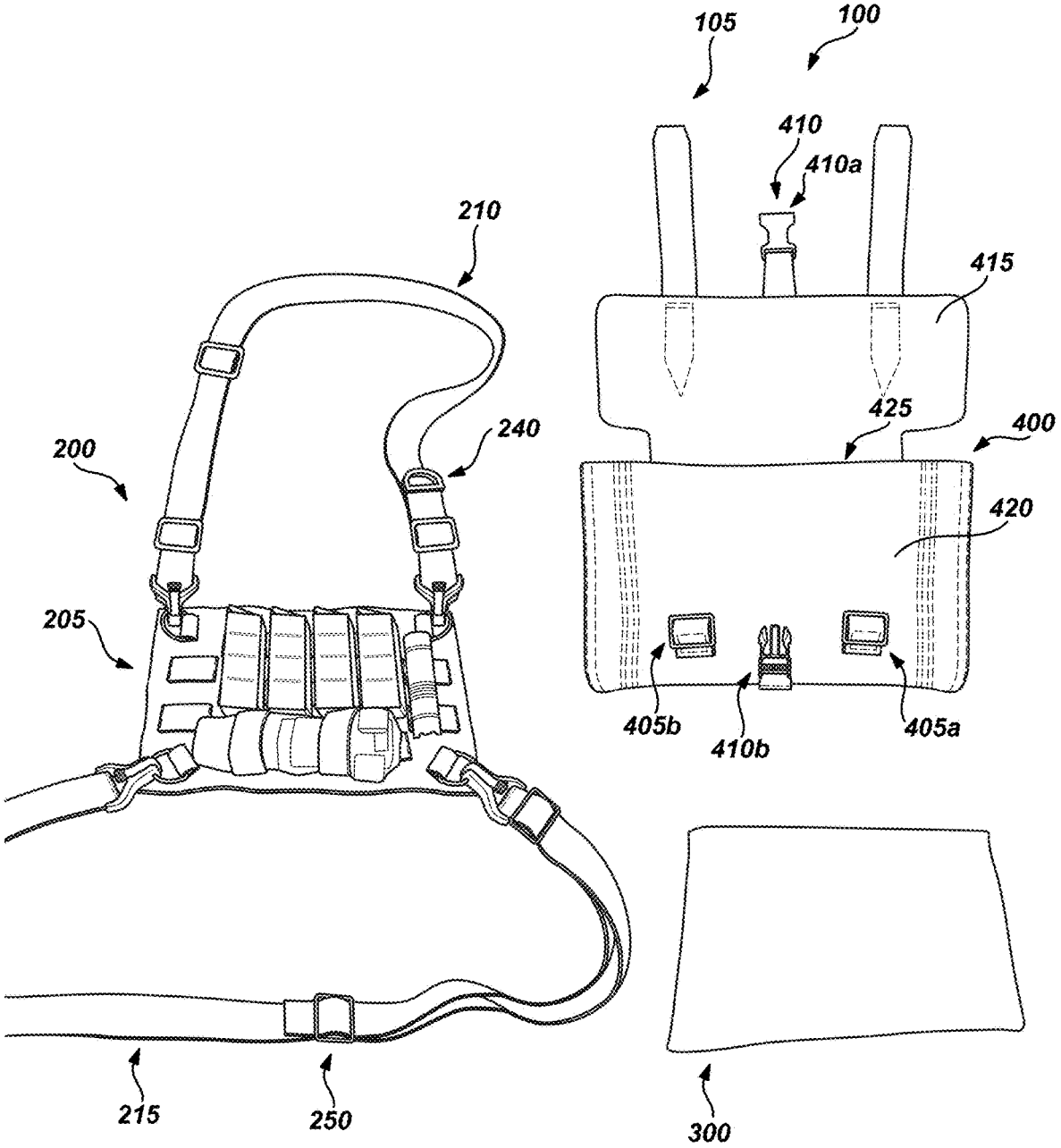
FIG. 1 is a top, perspective view of an exemplary embodiment of the present invention.

The exemplary disclosed system, apparatus, and method may be for holding equipment such as weapons, weapon-related items, self-defense items, and/or any other suitable item for use by a wearer of the system and apparatus. The exemplary disclosed system and apparatus may be a convertible (e.g., rapidly deployable) accessory that may be converted (e.g., changed or transformed) from an undeployed state to a deployed state as described below. The exemplary disclosed system and apparatus may include a shoulder connector (e.g., a shoulder strap) and a waist connector (e.g., a waist strap) that may be attached to the equipment assembly. A shield may also be included, which may be removably inserted into or attached to the equipment assembly. The equipment assembly and the waist strap may be selectively housed in the housing. In at least some exemplary embodiments, the shoulder strap may remain directly attached to the equipment assembly, but not directly attached to the housing, which may facilitate quick removal of the housing as described below. The apparatus may be worn in an undeployed state that may outwardly appear to others to be a shoulder bag (e.g., tablet or laptop bag), messenger satchel, purse, or other bag when worn by the user. For example in the undeployed state, the apparatus may hang at the wearer's hip (e.g., or other suitable position). For example, the housing may serve as a faux bag to give the appearance of a shoulder bag to others. For example, the housing may include faux buckles (e.g., non-operable faux buckles) that may not actually operate to fasten the bag (e.g., instead, a release device such as a single release device may function to actually open the housing for example as described below). In at least some exemplary embodiments, the release may be used to open the housing so that the housing may be removed (e.g., may fall to the ground) to reveal the exemplary disclosed equipment assembly. An adjustment device (e.g., a cinch strap with a D-ring pull handle or any other suitable adjustment device) of the shoulder strap may be used by the user to shorten the shoulder strap to raise the equipment assembly for example to the user's chest level (e.g., in a deployed state). The user may also attach the waist strap around the user's waist. The shield inserted or attached to the equipment assembly may serve to protect the user's chest or other body part when the exemplary disclosed apparatus is in the deployed state. In at least some exemplary embodiments, the apparatus (e.g., accessory) may thereby be changed from an undeployed state (e.g., a bag or satchel mode) to a deployed state (e.g., defense mode such as a self-defense mode) that may be useful for self-defense or law enforcement uses. For example, the exemplary disclosed apparatus may be used by on-duty or off-duty law enforcement or paramedics, concealed-carry citizens, and/or any other suitable users to be able to carry desired equipment (e.g., for self-defense) in a public setting without drawing attention (e.g., to have suitable equipment on hand to help effectively respond to a threat or emergency situation).

FIG. 1 illustrates an exemplary disclosed system 100 for holding equipment. System 100 may include a wearable apparatus such as an apparatus 105 that may be worn by a user for example as described below. Apparatus 105 may be an accessory for holding equipment for example as described below. Apparatus 105 may include an equipment assembly 200, a shield 300, and a housing 400. Shield 300 may be received and/or attached to equipment assembly 200. Equipment assembly 200 (e.g., and shield 300) may be removably received in housing 400.

Figure 2A:
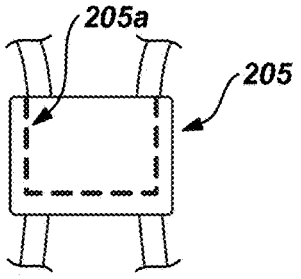
FIG. 2A is a schematic view of the exemplary component of the exemplary embodiment of FIG. 1.
Figure 2:
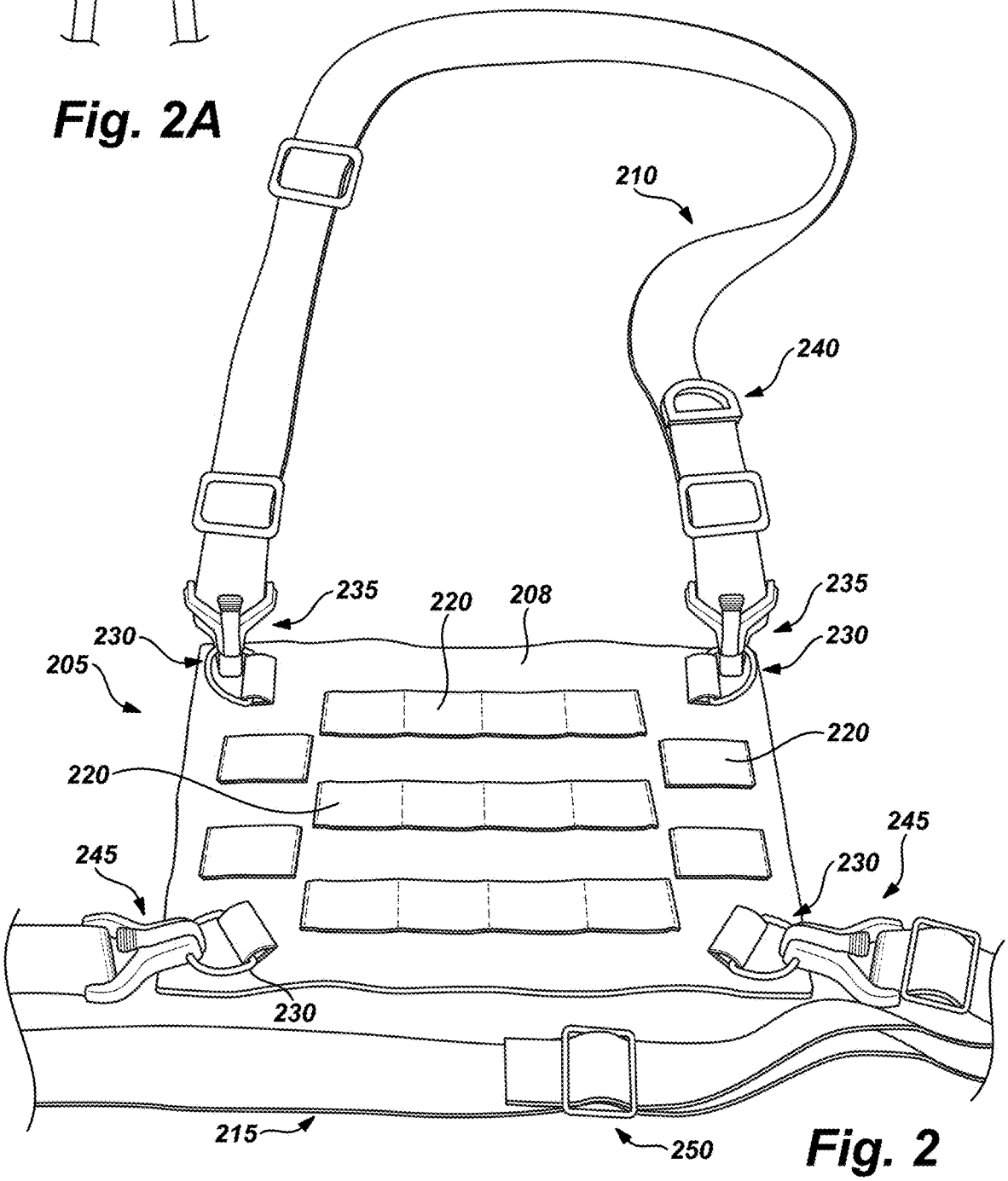
FIG. 2 is a top, perspective view of an exemplary component of the exemplary embodiment of FIG. 1.
Figure 3:
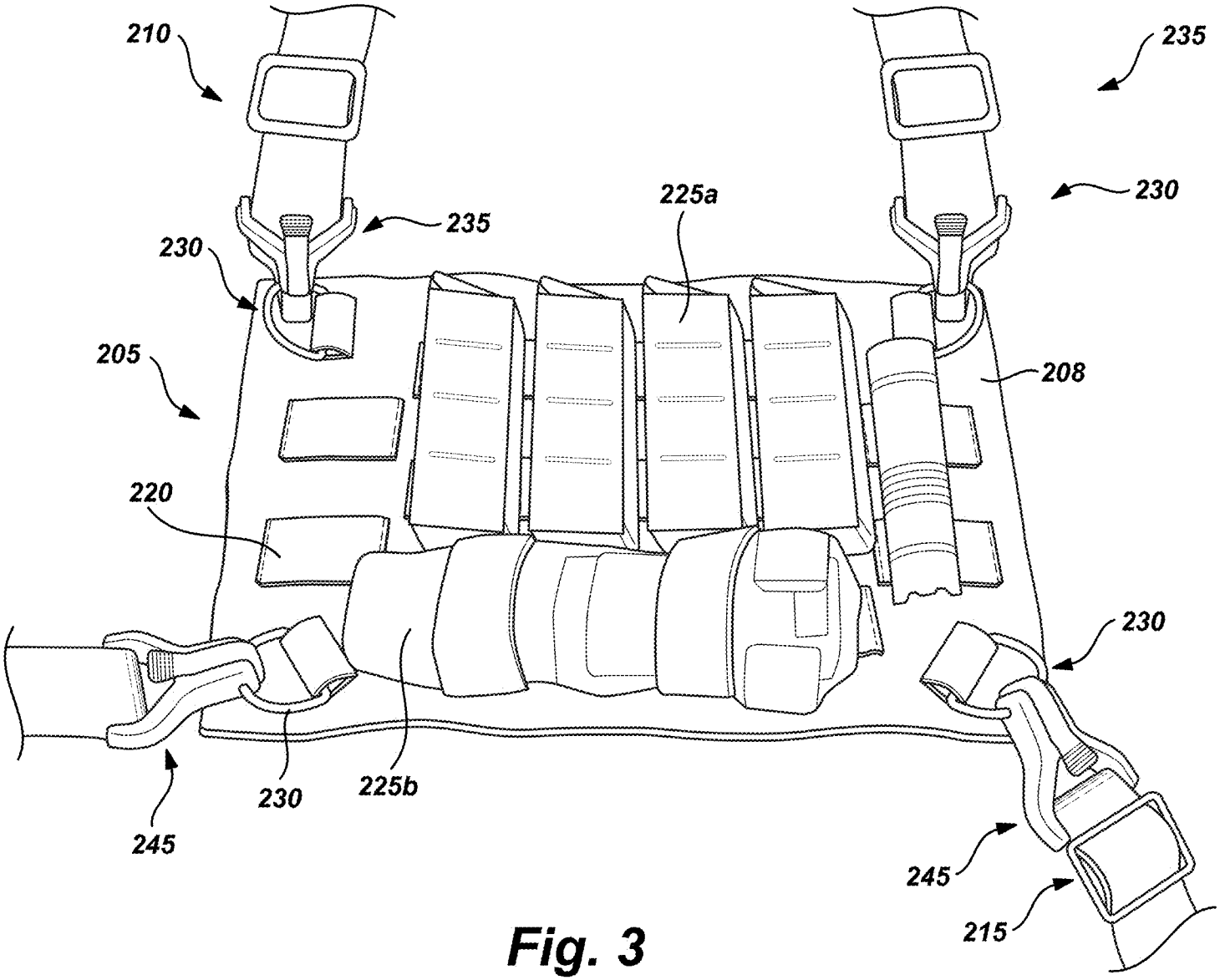
FIG. 3 is another top, perspective view of an exemplary component of the exemplary embodiment of FIG. 1.

As illustrated in FIGS. 1 through 3, equipment assembly 200 may include a body member 205, a shoulder connector 210, and a waist connector 215. Shoulder connector 210 and waist connector 215 may be used (e.g., adjusted and used) to secure body member 205 at desired locations of a body of a user wearing equipment assembly 200. As further described below, shoulder connector 210 and waist connector 215 may be attached (e.g., directly attached) to body member 205.

Body member 205, shoulder connector 210, and waist connector 215 may be formed from any suitable material for providing a wearable accessory for a user. For example, body member 205, shoulder connector 210, and waist connector 215 may be formed from fabric (e.g., cloth, nylon, and/or any other suitable natural or synthetic fabric), textile, fiber material, foam, ceramic, polyethylene, mesh, and/or any other suitable (e.g., similar) material. In at least some exemplary embodiments, body member 205, shoulder connector 210, and waist connector 215 may be formed from Cordura fabric, Kevlar, nylon webbing, ballistic nylon, and/or high-tenacity nylon material.

As illustrated in FIGS. 2 and 3, body member 205 may be used to hold or secure any desired equipment. Body member 205 may include a body wall 208 that may be a single wall or a double wall forming a pocket 205*a* (e.g., as illustrated in FIG. 2A) configured to receive (e.g., removably receive or fixedly receive) shield 300. The double wall of body wall 208 forming pocket 205*a* may be attached together and/or folded and attached to form pocket 205*a* via any suitable attachment technique such as, for example, stitching, sewn attachment, adhesive (e.g., a polyurethane adhesive, a silicone adhesive, a polyimide adhesive, a rubber adhesive, an epoxy adhesive, an acrylic adhesive, and/or any other suitable adhesive material), mechanical fasteners, and/or any other suitable attachment technique. In at least some exemplary embodiments, body member 205 may include a plurality of equipment connectors 220 disposed at a surface (e.g., a front surface facing away from a user when equipment assembly 200 is worn) of body wall 208 of body member 205. One or more equipment connectors 220 may be attached to the surface of body wall 208 via any suitable attachment technique such as, for example, stitching, sewn attachment, adhesive (e.g. the exemplary disclosed adhesive), mechanical fasteners, and/or any other suitable attachment technique. Equipment connector 220 may be any suitable type of connector such as, for example, a load-bearing strap (e.g., Modular Lightweight Load-carrying Equipment or MOLLE panel), Pouch Attachment Ladder System (PALS), clips, hook and loop fasteners, magnetic connectors, carabiners, adhesive connectors, zip ties, straps, bungee cords, and/or any other suitable attachment device for equipment. For example, a plurality of equipment connectors 220 may form an attachment grid (e.g., a webbing grid) at a surface (e.g., front surface) of body member 205.

Figure 4:
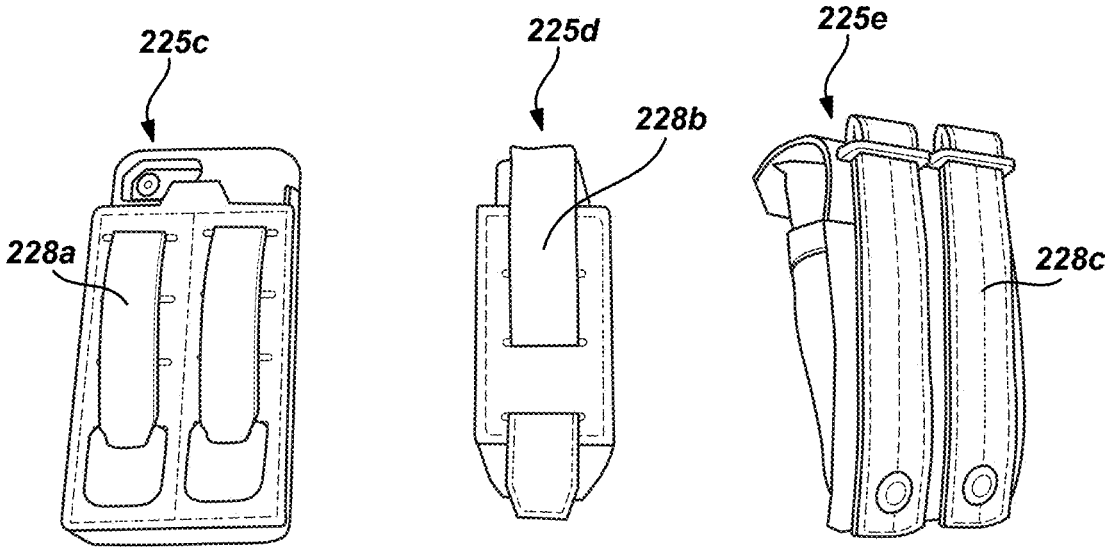
FIG. 4 is a top, perspective view of components of an exemplary embodiment of the present invention.

Any desired equipment items may be attached to body member 205 via equipment connectors 220 such as, for example, water bladders or other hydration systems, pouches, accessories for storing ammunition, food, medical items (e.g., first aid items), phones and/or smart devices or other electronic devices, identification (e.g., a badge such as a law enforcement badge disposed for example on a flap supported via equipment connector 220 to allow for example for quick recognition of a law enforcement officer), holsters for weapons (e.g., firearms, knives, pepper spray, tasers, nightsticks, brass knuckles, and/or any other desired weapons), tools (e.g., multi-tools), and/or any other desired items. As an illustrative example as shown in FIG. 3, a plurality of equipment items 225*a* (e.g., pouches formed from material similar to body member 205) and an equipment item 225*b* (e.g., a holder for a fluid container) may be attached to body member 205 via equipment connectors 220. Equipment items 225*a* and 225*b* may include equipment item connectors that may be configured to attach to equipment connectors 220. FIG. 4 illustrates additional exemplary embodiments of equipment items (e.g., equipment items 225*c*, 225*d*, and 225*e*) that may include respective equipment item connectors (e.g., equipment item connector 228*a* of equipment item 225*c*, equipment item connector 228*b* of equipment item 225*d*, and equipment item connector 228*c* of equipment item 225*e*) that may be configured to be connected to equipment connectors 220 of body member 205. Equipment items 225*a* and 225*b* may include equipment item connectors that may be similar to equipment item connectors 228*a*, 228*b*, and/or 228*c*. The exemplary disclosed equipment item connectors (e.g., equipment item connectors 228*a*, 228*b*, and/or 228*c*) may be any suitable devices for fastening such as, for example, clips, straps, and other suitable hardware. In at least some exemplary embodiments, the exemplary disclosed equipment item connectors may be MOLLE connectors that may be weaved through a MOLLE attachment grid formed by equipment connectors 220. As an illustrative example, the exemplary disclosed equipment item may be a pressure bandage and tourniquet having exemplary disclosed equipment item connectors that may be double-sided Velcro strips that may be attached to equipment connectors 220 that may form a MOLLE/PALS system.

Returning to FIGS. 2 and 3, body member 205 may include a plurality of connector attachments 230 for attaching (e.g., directly attaching or connecting) end portions of shoulder connector 210 and waist connector 215 to body member 205 (e.g., to the front surface of body wall 208). Connector attachments 230 may be any suitable attachment device or component for attaching (e.g., removably attaching or substantially permanently attaching) end portions of shoulder connector 210 and waist connector 215 to body member 205 such as, for example, an attachment ring or other suitable mechanical fastener (e.g., a plastic or metal fastener), a hook and loop fastener component, a magnetic connector, an adhesive connector, and/or any other suitable attachment device. Connector attachment 230 may be attached to body member 205 (e.g., to the front surface of body wall 208) via any suitable attachment technique such as, for example, stitching, sewn attachment, adhesive (e.g., the exemplary disclosed adhesive), mechanical fasteners, and/or any other suitable attachment technique. End portions of shoulder connector 210 and waist connector 215 may be removably attached or fixedly attached to body member 205 (e.g., to the front surface of body wall 208) via connector attachments 230. As an illustrative example, connector attachments 230 may be D-rings disposed at corners (e.g., four corners) of body member 205, with bottom (e.g., the bottom two) connector attachments 230 facing outward and top (e.g., the top two) connector attachments 230 disposed at an angle (e.g., canted at a 45-degree angle).

In at least some exemplary embodiments, body member 205 may be an inner core panel that may be received in housing 400 that may be an outer faux-shell. As an illustrative example, body member 205 may be a rectangle panel of ballistic nylon or similar resilient material for example as disclosed herein and may have dimensions of approximately 7.5" by 10.5" (e.g., or any other suitable dimensions) with pocket 205*a* that may be an interior pocket sealed by Velcro along the side of the panel. As an illustrative example, the interior of pocket 205*a* may receive shield 300 that may be a 6" by 9" threat level IIIA Kevlar panel. An outward (e.g., front) face of body member 205 (e.g., the panel) may be surfaced with equipment connectors 220 that may be MOLLE attachment points for the exemplary disclosed equipment items using the MOLLE attachment system, double-sided Velcro strips, and/or any other suitable connectors.

Shoulder connector 210 may be any suitable connector for supporting apparatus 105 at or from a shoulder of a user wearing apparatus 105. In at least some exemplary embodiments, shoulder connector 210 may be a shoulder strap. End portions of shoulder connector 210 may be attached (e.g., directly attached such as removably or substantially permanently attached) to connector attachments 230 of body member 205. A shoulder connector attachment 235 disposed at each end portion of shoulder connector 210 may be attached (e.g., directly attached such as removably or substantially permanently attached) to a respective connector attachment 230 of body member 205. Shoulder connector attachment 235 may be a mechanical fastener (e.g., a plastic or metal fastener), a hook and loop fastener component, a magnetic connector, an adhesive connector, and/or any other suitable attachment device. Shoulder connector attachment 235 may be attached at end portions of shoulder connector 210 via any suitable attachment technique such as, for example, stitching, sewn attachment, adhesive (e.g., the exemplary disclosed adhesive), mechanical fasteners, and/or any other suitable attachment technique. In at least some exemplary embodiments, shoulder connector attachment 235 may be a structural (e.g., plastic or metal) clip that may be directly attached (e.g., removably attached) to connector attachment 230 that may be a structural (e.g., metal or plastic) ring. As an illustrative example, shoulder connector attachment 235 may include a squeeze clip and a tri-glide fastener of shoulder connector 210 that may be a 1.5" nylon belt (e.g., or any other suitable strap or belt).

Shoulder connector 210 may include an adjustment device 240. Adjustment device 240 may be a quick adjustment device such as a quick adjuster slide. Adjustment device 240 may be any suitable device for selectively increasing and decreasing (e.g., lengthening and shortening) a length (e.g., an extension length that determines how high or low body member 205 hangs from a user's shoulder) of shoulder connector 210. For example, an extension length of shoulder connector 210 may be increased or decreased by operation of adjustment device 240. Adjustment device 240 may be a cinch strap handle, a cam buckle, a ratchet strap buckle, or any other suitable device for selectively lengthening and shortening a connector (e.g., a belt or strap). In at least some exemplary embodiments, adjustment device 240 may be a cinch strap with a D-ring pull handle. The user wearing apparatus 105 may quickly shorten a length of shoulder connector 210 via use of adjustment device 240, thereby raising body member 205 relative to a user (e.g., raising body member 205 from the user's hip level or a relatively lower level of the user in the undeployed state to the user's chest level or a relatively higher level of the user in the deployed state). Adjustment device 240 may be attached to shoulder connector 210 similarly to the attachment of shoulder connector attachment 235 to shoulder connector 210 described above.

In at least some exemplary embodiments and as an illustrative example, adjustment device 240 may provide for a quick-slide length reduction of shoulder connector 210 based on shoulder connector 210 including a portion permanently attached to one end of a tri-glide fastener (e.g., with adjustment device 240 that may include a D-Ring pull tab affixed to the other side). The permanently affixed portion of shoulder connector 210 may be weaved through a quick clip and back through a center of the tri-glide to form a remaining portion of shoulder connector 210. An opposite end of shoulder connector 210 may be weaved through another quick-clip and secured by one or more fasteners (e.g., two tri-glide fasteners). Tension from the fasteners (e.g., tri-glide fasteners) may help to secure one or both ends of shoulder connector 210. An opposite end of shoulder connector 210 may not be permanently attached, thereby allowing the entire shoulder connector 210 to be reversed and rewoven and allowing for either left and right hand use of adjustment device 240. Any other suitable configuration for providing the exemplary disclosed operation of adjustment device 240 and shortening and lengthening of shoulder connector 210 may also be used.

Waist connector 215 may be any suitable connector for supporting apparatus 105 at a waist of a user wearing apparatus 105. In at least some exemplary embodiments, waist connector 215 may be a waist strap. End portions of waist connector 215 may be attached (e.g., directly attached such as removably or substantially permanently attached) to connector attachments 230 of body member 205. A waist connector attachment 245 disposed at each end portion of waist connector 215 may be attached (e.g., directly attached such as removably or substantially permanently attached) to a respective connector attachment 230 of body member 205. In at least some exemplary embodiments, at least one waist connector attachment 245 may be removably attachable to respective connector attachment 230 of body member 205. Waist connector attachment 245 may be generally similar to shoulder connector attachment 235. In at least some exemplary embodiments, waist connector attachment 245 may be a structural (e.g., plastic or metal) clip that may be removably attached to connector attachment 230 that may be a structural (e.g., metal or plastic) ring. Waist connector 215 may also include an adjustment buckle 250 (e.g., a plastic or metal adjustment buckle) that may be disposed at an intermediate (e.g., central) portion of waist connector 215 and may be used to adjust a length of waist connector 215. In at least some exemplary embodiments, adjustment buckle 250 may be generally similar to adjustment device 240. As an illustrative example, waist connector attachment 245 may include a squeeze clip and one or more tri-glide fasteners of shoulder connector 210 that may be a 1.5" nylon belt (e.g., or any other suitable connector such as a belt or strap). In at least some exemplary embodiments, both shoulder connector 210 and waist connector 215 may be substantially similar (e.g., include substantially similar components) and may have different lengths. Both shoulder connector 210 and waist connector 215 may be "unwoven" at one end and switched to the opposite side (e.g., switched between connector attachments 230) for either left-handed or right-handed users. For example, both shoulder connector 210 and waist connector 215 may have a quick-slide reduction strap similar to as described above regarding shoulder connector 210 (e.g., regarding adjustment device 240).

Shield 300 may be any suitable shield such as a ballistic shield. Shield 300 may be removably received in pocket 205*a* of body member 205. Shield 300 may also be substantially permanently or fixedly attached within pocket 205*a* (e.g., completely embedded within body member 205) or removably or substantially permanently or fixedly attached to a surface of body wall 208 (e.g., via mechanical fasteners, adhesive, and/or any other suitable attachment technique). Shield 300 may be formed from any suitable material for protecting a user wearing apparatus 105 from projectiles (e.g., fired from a threat weapon) such as any suitable structural material. Shield 300 may be formed from metal material, ceramic material, polymeric material, aramid material, polyethylene material (e.g., variations of polyethylene material), composite material, and/or any other suitable structural material. For example, shield 300 may be formed from ultra-high molecular weight polyethylene (UHMWPE) material. In at least some exemplary embodiments, shield 300 may be formed from a combination of ceramic, UHMWPE, and/or other composite material configurations. In at least some exemplary embodiments, shield 300 may be formed from Kevlar material. Shield 300 may be formed from a single layer of the exemplary disclosed structural material or from multiple layers of the same material or from multiple layers of varying exemplary disclosed material. Shield 300 may have any suitable shape for providing a shield such as, for example, a rectangular shape, square shape, polygonal shape, elliptical shape, circular shape, or any other suitable shape. Shield 300 may be formed as an elongated, relatively thin (e.g., flat) member.

Housing 400 may be formed from any suitable material for housing equipment assembly 200 such as, for example, synthetic or natural fabrics, textiles, and/or other materials. For example, housing 400 may be formed from plastic (e.g., polyester, polypropylene, vinyl, and/or other suitable plastics), cotton, leather (e.g., natural leather or synthetic leather such as PVC leather), denim, plant-based material, suede, canvas, and/or any other suitable materials. Housing 400 may be configured to outwardly appear to others to be an article of clothing (e.g., clothing accessory of any desired color or colors) such as a handbag, a shoulder bag (e.g., tablet or laptop bag), a messenger or courier satchel, a purse, or any other clothing article or accessory when worn by the user. For example, housing 400 may actually serve as a faux clothing article or accessory (e.g., a faux bag) to give the appearance of a bag (e.g., shoulder bag) or similar article to others.

Figure 5:
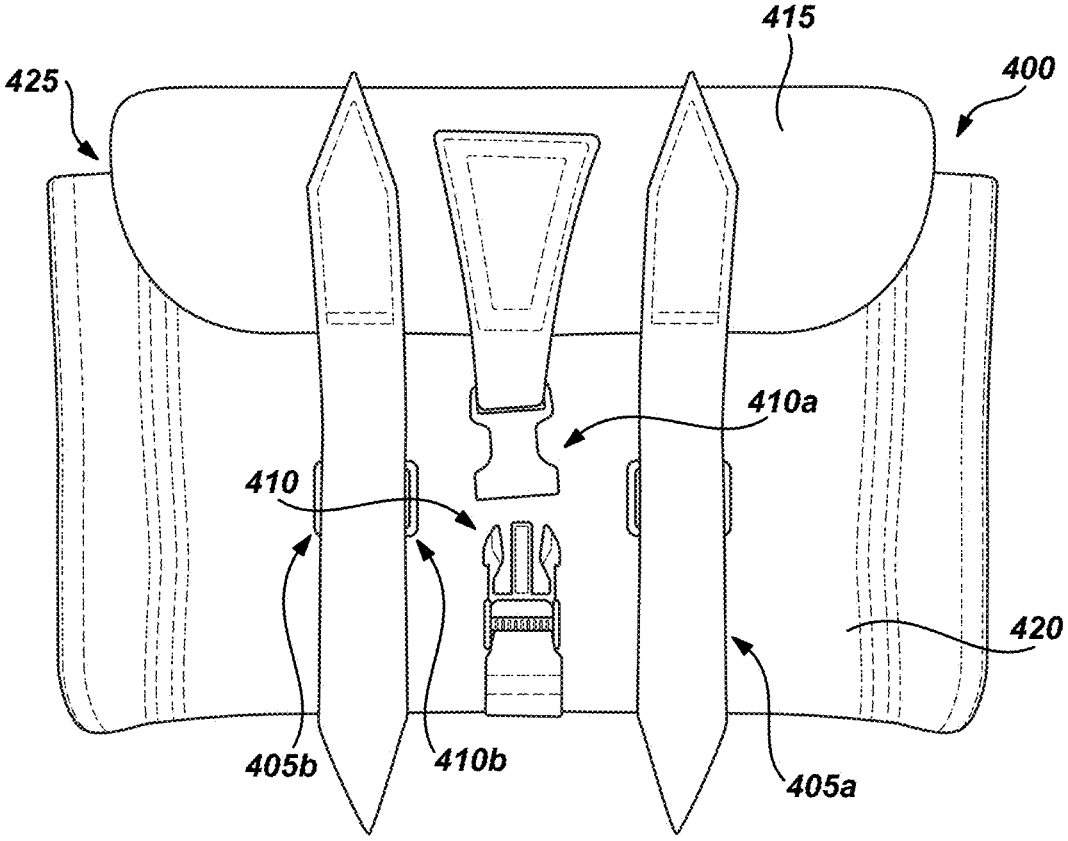
FIG. 5 is a top, perspective view of an exemplary component of the exemplary embodiment of FIG. 1.
Figure 6:
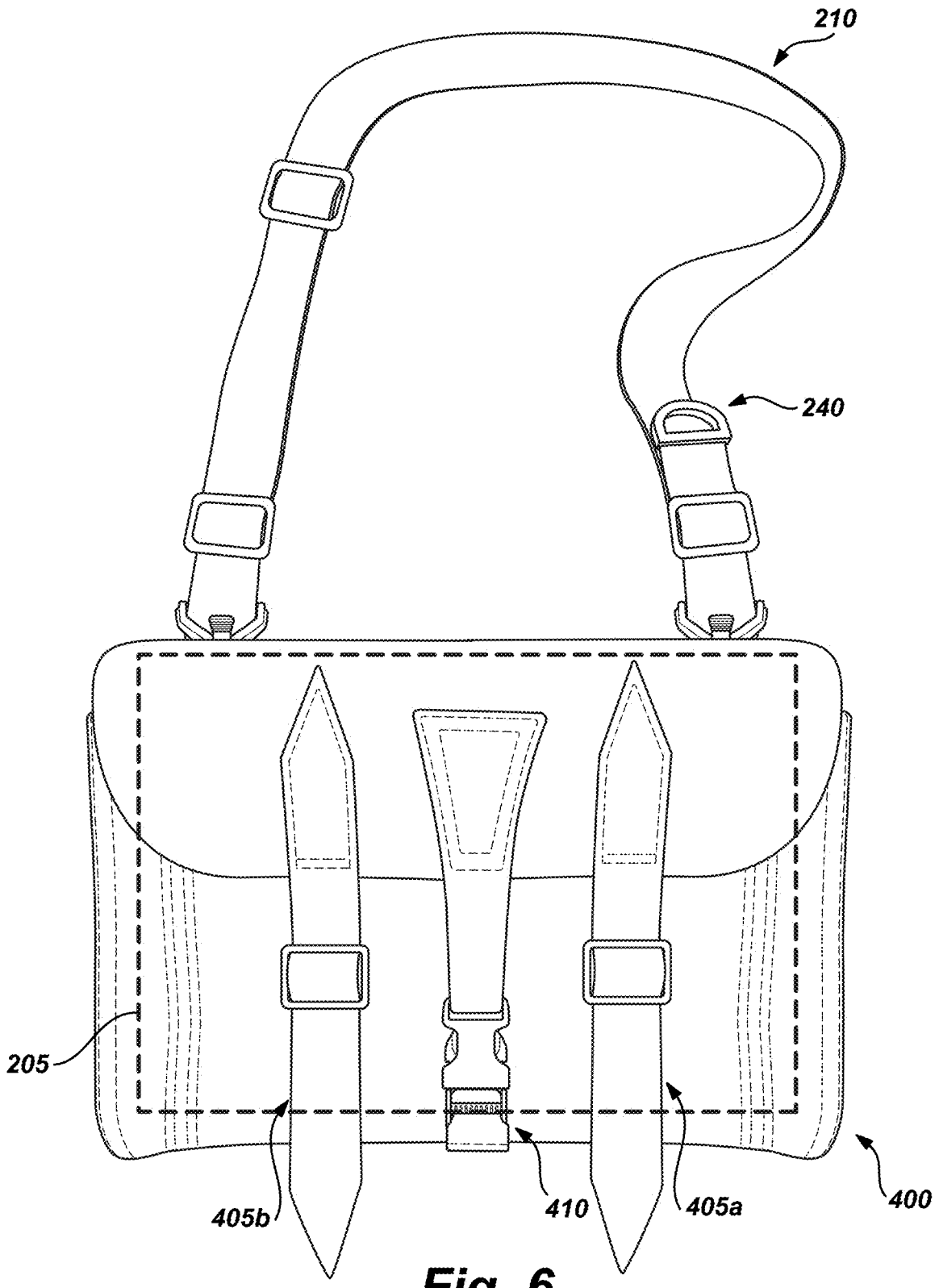
FIG. 6 is another top, perspective view of components of the exemplary embodiment of FIG. 1.

In at least some exemplary embodiments, housing 400 may include one or more faux fasteners (e.g., non-operable faux fasteners) that may outwardly appear to be fastening devices but may not actually operate to fasten the bag. For example as illustrated in FIGS. 1, 5, and 6, housing 400 may include one or more faux fasteners 405*a* and/or 405*b*. Each of faux fastener 405*a* and/or faux fastener 405*b* may appear to be for example a buckle, button, zipper, clasp, hook and loop fastener, rope or string, slider, snap, and/or any other apparent fastener, but may actually be ornamental or decorative and non-operable (e.g., not functional).

Housing 400 may also include (e.g., in addition to faux fasteners 405*a* and/or 405*b*) a release device 410 (e.g., including one or more release device components 410*a* and/or 410*b*) for example as illustrated in FIG. 1. Release device 410 (e.g., including one or more release device components 410*a* and/or 410*b*) may be a quick release device (e.g., may include one or two or more quick release device components). Release device components 410*a* and/or 410*b* may be side release buckle components (e.g., of a side release buckle), buttons (e.g., snap buttons), magnetic connectors, hook and loop fastener components, spring snap components, quick-release snap hooks, or any other suitable release device (e.g., quick-release device). In at least some exemplary embodiments, release device 410 may be a quick-release device that may be used to open (e.g., quickly open) housing 400 so that housing 400 may be removed (e.g., may be quickly removed and/or may fall to the ground) to reveal body member 205 of equipment assembly 200 worn by a user.

Figure 7:
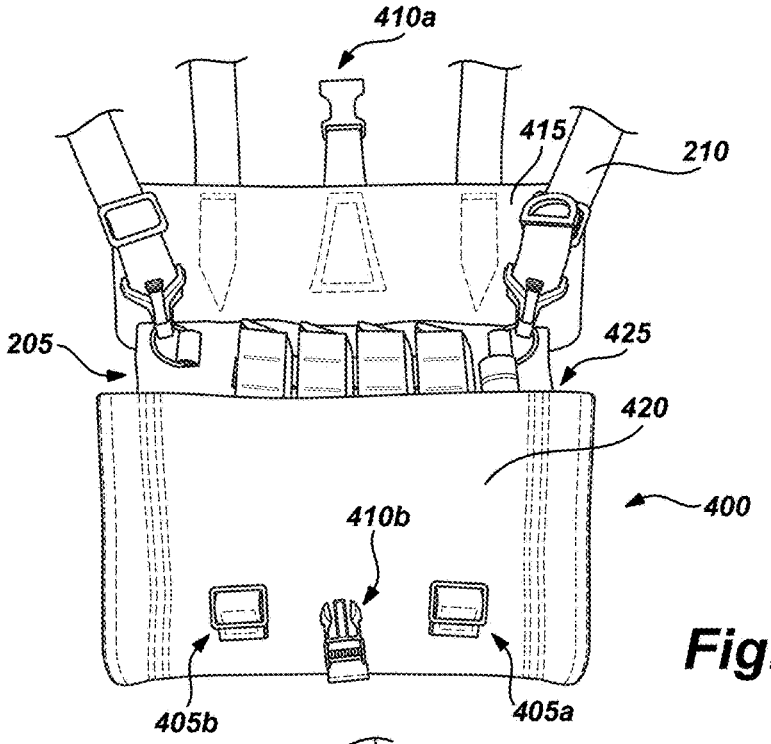
FIG. 7 is another top, perspective view of components of the exemplary embodiment of FIG. 1.
Figure 8:
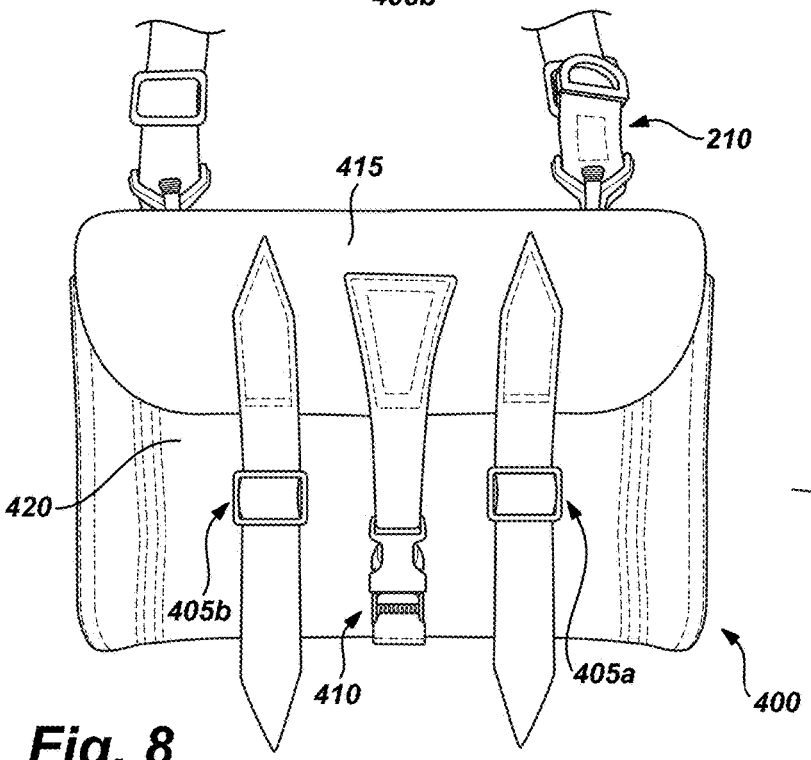
FIG. 8 is another top, perspective view of components of the exemplary embodiment of FIG. 1.

Housing 400 may include a housing cover 415 and a housing body 420 for example as illustrated in FIG. 1. Housing cover 415 and housing body 420 may be integrally formed portions of housing 400 or may be attached to each other via any suitable technique (e.g., stitching, sewn attachment, adhesive, mechanical fasteners, and/or any other suitable attachment technique). Housing body 420 may form a housing cavity 425 that may be selectively covered by housing cover 415. Housing cavity 425 may selectively receive (e.g., surround) body member 205 (e.g., and waist connector 215) so that housing 400 houses (e.g., conceals) body member 205 (e.g., and waist connector 215), for example as illustrated in FIGS. 7 and 8. Returning to FIGS. 5 and 6, release device components 410*a* and 410*b* may be corresponding components of release device 410 that are attached to both housing cover 415 and housing body 420 so as to attach housing cover 415 to housing body 420 (e.g., or close housing cover 415 over housing cavity 425) when release device 410 (e.g., including release device components 410*a* and/or 410*b*) is fastened. When release device 410 (e.g., including release device components 410*a* and/or 410*b*) is unfastened, housing cover 415 may be detached from housing body 420, and housing 400 may be removed (e.g., pulled off of) and/or fall from equipment assembly 200 (e.g., under the weight or force of gravity).

Figure 8A:
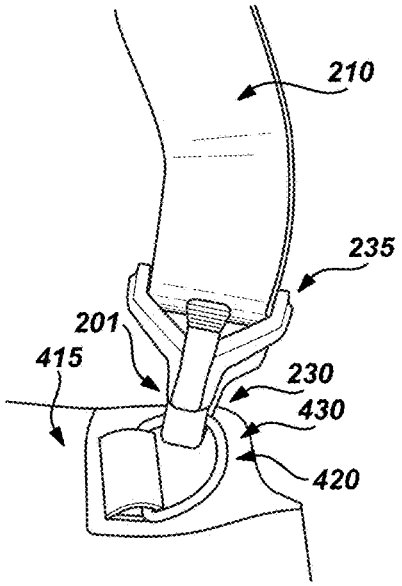
FIG. 8*a* is a detailed top, perspective view of components of the exemplary embodiment of FIG. 1.

In at least some exemplary embodiments and as illustrated in FIG. 6, housing 400 may contain (e.g., receive or hold) body member 205 when release device 410 (e.g., including release device components 410*a* and/or 410*b*) is fastened. Housing 400 may be removed (e.g., pulled off) and/or fall to the ground when release device 410 (e.g., including release device components 410*a* and/or 410*b*) is unfastened. For example, housing 400 may be relatively easily removed and/or fall to the ground because housing 400 may not be attached (e.g., directly attached) to shoulder connector 210. For example, shoulder connector 210 may be attached (e.g., directly attached) to body member 205 of equipment assembly 200 and may thereby indirectly support housing 400 when housing 400 contains body member 205 (e.g., based on housing 400 receiving or holding body member 205). However, shoulder connector 210 may not be directly attached to housing 400. Shoulder connector 210 may be directly attached to body member 205 (e.g., based on direct attachment of shoulder connector attachment 235 to connector attachment 230). For example as illustrated in FIG. 8*a*, direct attachment (e.g., direct connection or attachment of shoulder connector 210 to body member 205) via a direct attachment portion 201 of shoulder connector attachment 235 of shoulder connector 210 to connector attachment 230 of body member 205 may be made through a housing gap 430 formed between housing cover 415 and housing body 420. Direct attachment portion 201 may include attachable portions of body member 205 and shoulder connector 210 such as, for example, portions of body member 205 including and/or at or near connector attachment 230 and portions of shoulder connector 210 including and/or at or near shoulder connector attachment 235. Shoulder connector 210 may thereby pass through housing gap 430 to be attached (e.g., directly attached) to body member 205, without being attached (e.g., directly attached) to housing 400. The exemplary disclosed attachment may allow for housing 400 to be removed (e.g., pulled off) and/or fall to the ground when release device 410 (e.g., including release device components 410*a* and/or 410*b*) is unfastened.

In at least some exemplary embodiments and as an illustrative example, housing 400 may be an outer faux shell made of leather to simulate the appearance of a messenger satchel or shoulder bag. The faux shell may receive (e.g., be wrapped around) body member 205 (e.g., similar to an envelope). Housing 400 may be equipped with two faux buckles on either side of housing cover 415 (e.g., a top-flap), but the faux buckles may be decorative and may not actually fasten housing cover 415 to housing body 420. Release device 410 may be a center buckle or other fastener (e.g., or a buckle or other fastener at any other desired location) that may selectively attach housing cover 415 to housing body 420 to maintain housing 400 supported (e.g., indirectly supported) on body member 205. Strips of elastic may be disposed on housing 400 to provide stability (e.g., flexible support) to housing 400 when receiving body member 205.

The exemplary disclosed system, apparatus, and method may be used in any suitable application for holding equipment such as weapons, weapon-related items, and/or items for self-defense. The exemplary disclosed system, apparatus, and method may be used in any suitable application involving using a wearable apparatus (e.g., accessory) for self-defense. The exemplary disclosed system, apparatus, and method may be used in any suitable application for converting a wearable accessory from a first state (e.g., undeployed state) to a second state (e.g., deployed state) for use in self-defense.

Figure 9A:
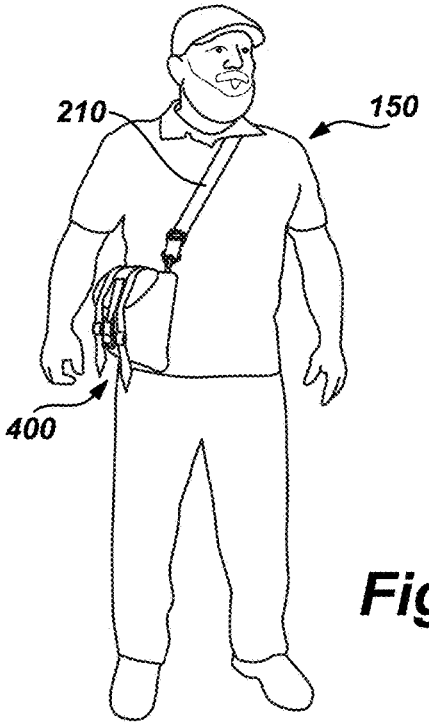
FIGS. 9A, 9B, 9C, 9D, 9E, 9F, and 9G illustrate an exemplary process for using the exemplary embodiment of FIG. 1.

FIGS. 9A through 9G illustrate an exemplary process for using the exemplary disclosed apparatus (e.g., apparatus 105), for example including converting (e.g., changing or transforming) apparatus 105 from a first state (e.g., undeployed state) to a second state (e.g., deployed state). As illustrated in FIG. 9A, a user (e.g., a wearer such as a user 150) may wear apparatus 105 in the undeployed state. For example, the user may wear apparatus 105 in the undeployed state that may outwardly appear to others to be a shoulder bag (e.g., tablet or laptop bag), messenger satchel, purse, or other bag. In the undeployed state for example as illustrated in FIG. 9A, body member 205 and waist connector 215 may be received (e.g., concealed) in housing 400. For example, housing cavity 425 may receive body member 205 (e.g., and waist connector 215) so that housing 400 conceals body member 205 (e.g., and waist connector 215). In the undeployed state, housing cover 415 may be attached to housing body 420 via release device 410 so that housing 400 may be indirectly attached to and indirectly supported by body member 205 and shoulder connector 210 (e.g., shoulder connector 210 may be directly attached to body member 205, but not directly attached to housing 400, so that shoulder connector 210 directly attaches to and supports body member 205, thereby indirectly supporting housing 400 fastened around body member 205).

Figure 9B:
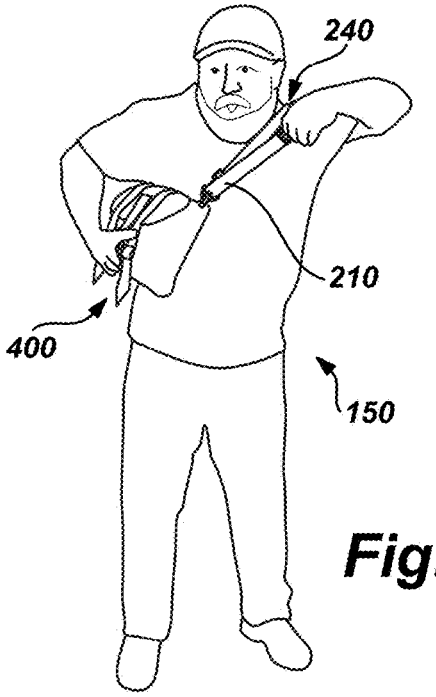

If the user determines that apparatus 105 should be converted (e.g., changed or transformed) to the deployed state, the user may begin the conversion for example as illustrated in FIG. 9B. For example, the user may recognize a threat or determine that a threat may exist. As illustrated in FIG. 9B, the user may operate adjustment device 240 of shoulder connector 210 to shorten a length (e.g., an extension length) of shoulder connector 210 so that body member 205 may be raised relative to the user's body. For example, the user may operate adjustment device 240 (e.g., pull a slider tab of adjustment device 240 upward in at least some exemplary embodiments), thereby decreasing the length of shoulder connector 210 and bringing body member 205 to the center of the user's chest. For example, shield 300 disposed at body member 205 may thereby be moved to protect vital organs of the user (e.g., at a "center-mass" of the user). Also for example, the exemplary disclosed equipment items held at body member 205 may be moved to a more use-friendly workspace of the user.

Figure 9C:
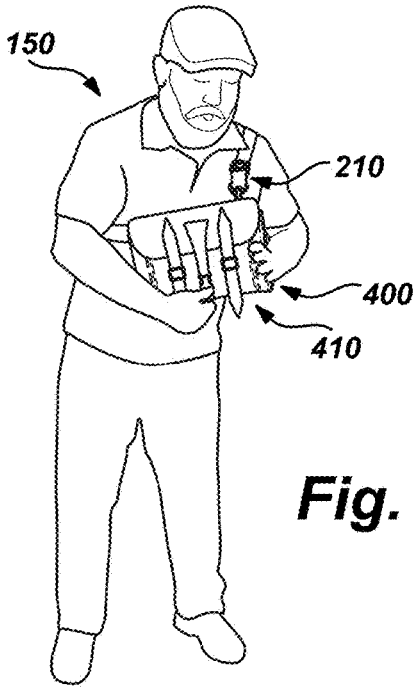
Figure 9D:
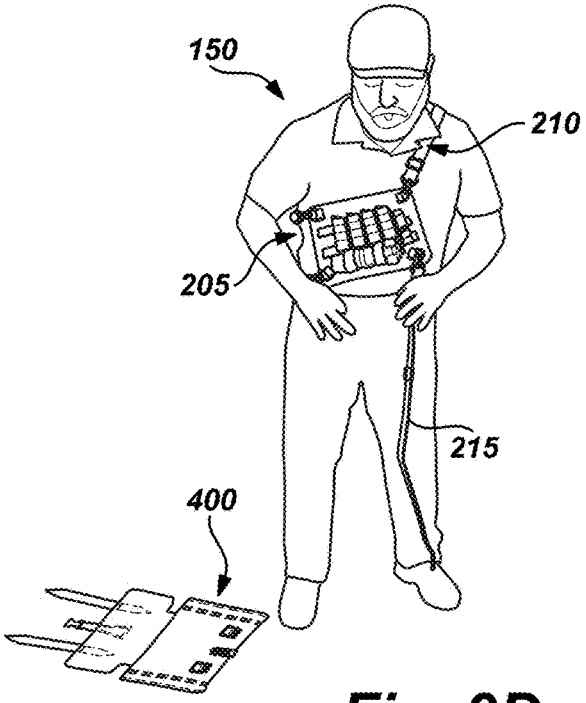

As illustrated in FIG. 9C, the user may operate release device 410 to detach housing cover 415 from housing body 420. As an illustrative example in the case when release device 410 may be a side release buckle, the user may grip and depress two side release tabs (e.g., of release device component 410*b* while holding release device component 410*a* to separate release device component 410*b* from release device component 410*a*). For example, the user may pull down on detached release device component 410*b*, which may pull housing 400 in a downward motion and urge (e.g., force) housing cover 415 to slide over a top portion of body member 205 and (e.g., upon clearing the top of body member 205) housing 400 may fall (e.g., be discarded, such as temporarily discarded) to the ground or floor for example as illustrated in FIG. 9D. Body member 205 (e.g., previously housed in housing 400) may now be exposed (e.g., unconcealed) as illustrated in FIG. 9D. Also for example as illustrated in FIG. 9D, waist connector 215 (e.g., previously housed in housing 400) may now be exposed (e.g., unconcealed) and may drop to a dangling position from body member 205. For example, a first waist connector attachment 245 at a first end of waist connector 215 may be connected to body member 205 and a second waist connector attachment 245 at a second end of waist connector 215 may be unconnected to body member 205 so that waist connector 215 dangles from body member 205. In at least some exemplary embodiments, both waist connector attachments 245 may be connected to respective connector attachments 230 of body member 205.

Figure 9E:
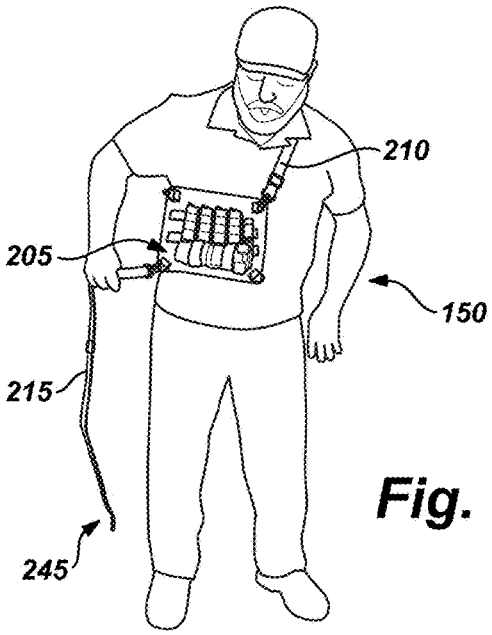

As illustrated in FIG. 9E, the user may manipulate (e.g., grip, handle, and move) waist connector 215 to secure waist connector 215 around the user's waist. For example, the user may move the dangling waist connector attachment 245 around the user's waist (e.g., around the user's back) and then attach it to the opposite (e.g., opposite bottom) respective connector attachment 230 of body member 205 (e.g., as illustrated in FIG. 1). Waist connector 215 may be pre-adjusted to fit the user's waist and/or adjusted manually by the user (e.g., to be snug) for example by adjusting adjustment buckle 250 of waist connector 215.

Figure 9F:
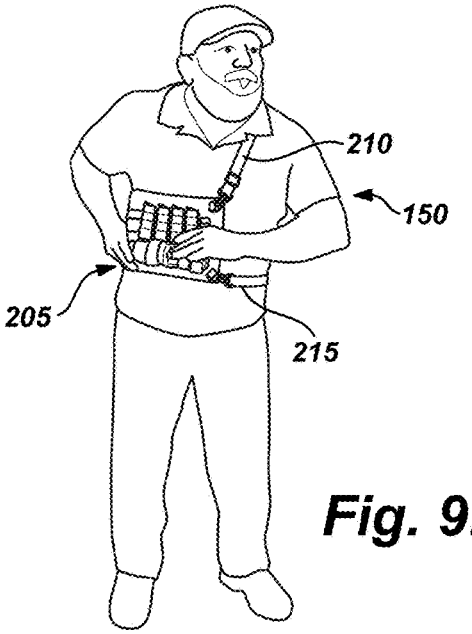
Figure 9G:
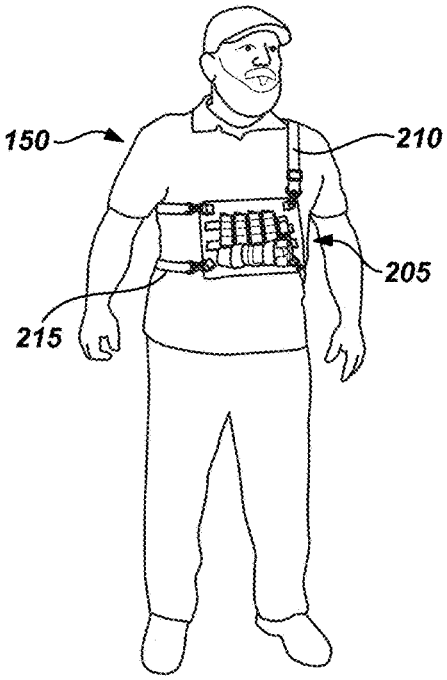

As illustrated in FIG. 9F, the user may center body member 205 at the user's front by rotating body member 205 relative to the user's body. For example, the user may rotate body member 205, which may also rotate attached shoulder connector 210 and attached waist connector 215, to move body member 205 to a desired front position on the user's body. For example, the user may make a final adjustment of positioning body member 205 substantially at the center of the user's chest. Tension (e.g., from connectors 210 and/or 215) and/or friction force between body member 205 (e.g., and/or connectors 210 and/or 215) and the user (e.g., user's clothing) may substantially maintain equipment assembly 200 in place in the deployed state (e.g., with body member 205 in a substantially center position) for example as illustrated in FIG. 9G.

The exemplary disclosed process steps described above regarding FIGS. 9A through 9G may be performed in any suitable order to convert (e.g., change or transform) apparatus 105 from the undeployed state of FIG. 9A to the deployed state of FIG. 9G. For example, the exemplary disclosed steps may be performed in varying order relative to each other. As an illustrative example, the step of removing and/or dropping housing 400 described above regarding FIGS. 9C and 9D may be performed before shortening shoulder connector 210 as described above regarding FIG. 9B. Apparatus 105 may be converted (e.g., changed or transformed) from the deployed state of FIG. 9G to the undeployed state of FIG. 9A by generally following the reverse order of steps of FIGS. 9A through 9G described above.

Figure 10:
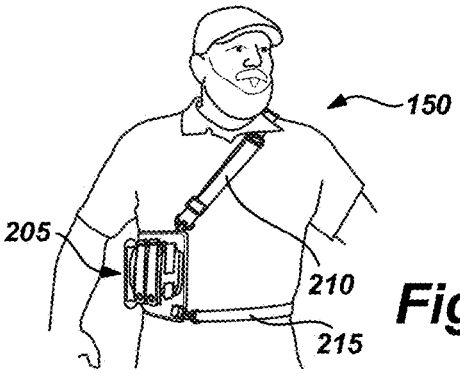
FIG. 10 illustrates another exemplary use of the exemplary embodiment of FIG. 1.
Figure 11:
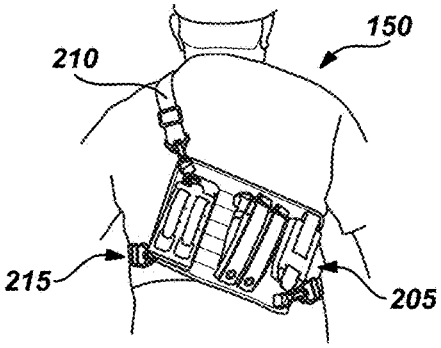
FIG. 11 illustrates another exemplary use of the exemplary embodiment of FIG. 1.

When in the deployed state, apparatus 105 may be rotated as desired to differing positions on the user (e.g., wearer such as user 150), depending for example on physical and spatial criteria of use desired by the user. For example, the user may move equipment assembly 200 (e.g., rotate body member 205, shoulder connector 210, and/or waist connector 215) so that body member 205 is moved to a side position of the user for example as illustrated in FIG. 10. For example with equipment assembly 200 in the side position as illustrated in FIG. 10, the user may more easily go into a prone position without equipment assembly 200 acting as an obstacle or creating discomfort (e.g., or to provide for a clear workspace in front of the user for example if providing emergency medical care or performing other tasks). Also for example as illustrated in FIG. 11, equipment assembly 200 may be rotated relative to the user's body so that body member 205 is positioned at a back position (e.g., allowing for more flexibility of movement and/or a slimmer user profile for the wearer). Equipment assembly 200 may be moved (e.g., rotated) relatively quickly between the exemplary disclosed center position, side position, and back positions (e.g., with minimal time and/or with a single hand of the user).

Figure 12:
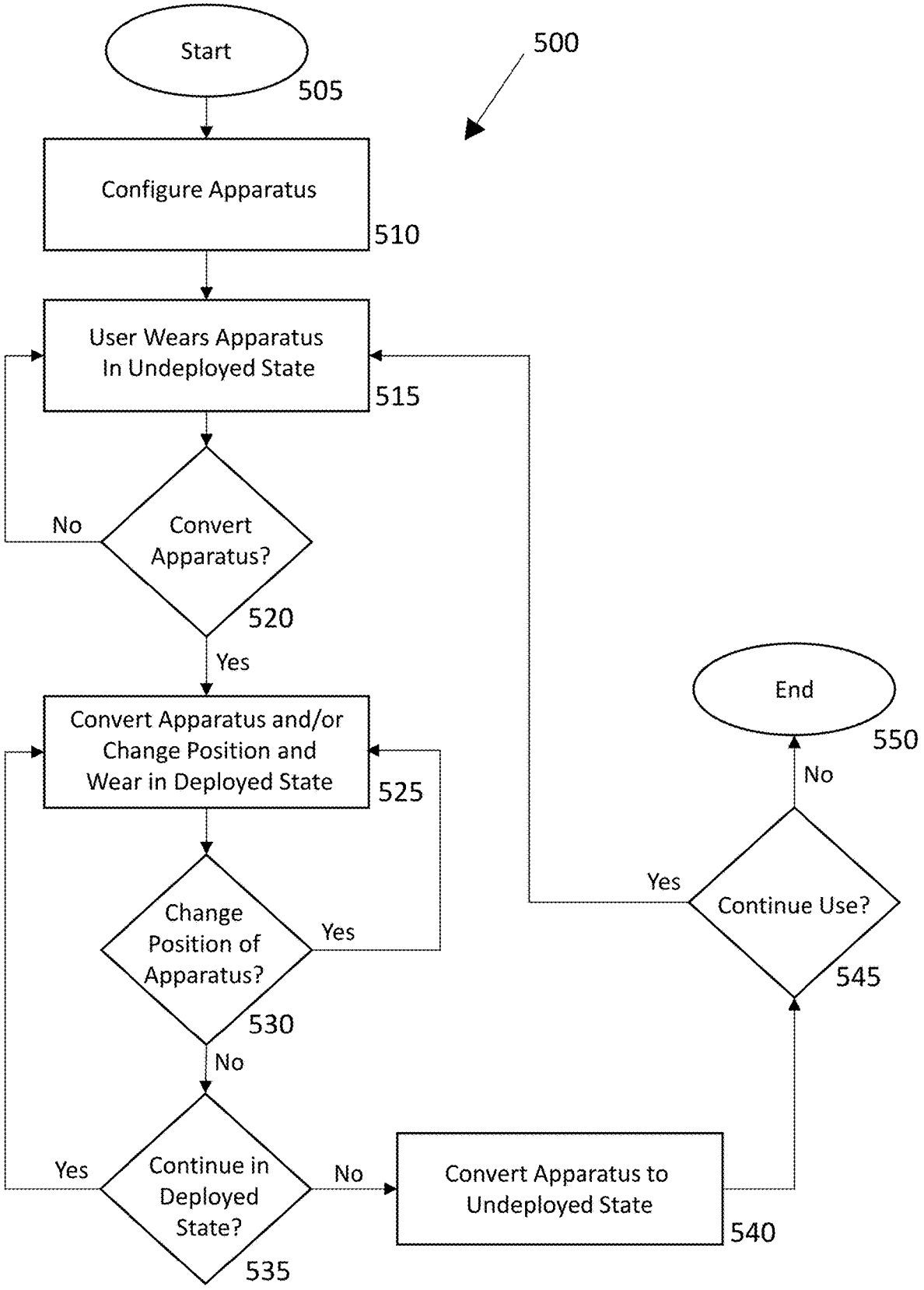
FIG. 12 illustrates an exemplary process of using at least some exemplary embodiments of the present disclosure.

FIG. 12 illustrates an exemplary process of using the exemplary disclosed system and apparatus. Process 500 begins at step 505. At step 510, a user (e.g., user 150) may configure apparatus 105. For example, the user may attach desired exemplary disclosed equipment items to body member 205 for example as described above. The user may also configure apparatus 105 to be in the exemplary disclosed undeployed state for example as described above. The user may wear apparatus 105 in the exemplary disclosed undeployed state at step 515 (e.g., in which apparatus 105 may outwardly appear to be a bag or other similar accessory for example as described above).

At step 520, the user may determine whether or not to convert (e.g., change or transform) apparatus 105 from the undeployed state to the deployed state. For example, the user may determine that apparatus 105 should be changed from the undeployed state to the deployed state when the user recognizes a threat or determines that a threat may exist. If the user determines that apparatus 105 should not be deployed, process 500 returns to step 515. As many iterations as desired of steps 515 and 520 may be performed. If the user determines that apparatus 105 should be deployed, process 500 proceeds to step 525.

At step 525, the user may convert (e.g., change or transform) apparatus 105 from the undeployed state to the deployed state for example as described above regarding FIGS. 9A through 9G. The user may wear apparatus 105 (e.g., equipment assembly 200) in the deployed state. For example, the user may respond to a threat and/or take any other suitable action using the exemplary disclosed equipment items and/or when being shielded by shield 300 positioned in the deployed state for example as described above. At step 530, the user may determine whether or not to change a position of apparatus 105 for example based on an activity or task to be performed by the user in the deployed state. If the user determines that the position of apparatus 105 is to be changed, process 500 may return to step 525, and the position of body member 205 may be changed between the center position (e.g., as illustrated in FIG. 9G), the side position (e.g., as illustrated in FIG. 10), and/or the back position (e.g., as illustrated in FIG. 11) for example as described above. As many iterations as desired of steps 525 and 530 may be performed. If the user determines that the position of apparatus 105 is not to be changed, process 500 proceeds to step 535.

At step 535, the user may determine whether or not to continue in the deployed state. If the user determines that the user should continue in the deployed state, process 500 returns to step 525. As many iterations as desired of steps 525 through 535 may be performed. If the user determines that the user is not to continue in the deployed state, process 500 proceeds to step 540.

At step 540, the user may convert (e.g., change or transform) apparatus 105 from the deployed state to the undeployed state for example as described above (e.g., by following generally the reverse steps of FIGS. 9A through 9G). At step 545, the user may determine whether or not to continue use of apparatus 105. If the user determines that the user will continue use of apparatus 105, process 500 returns to step 515 (e.g., or step 510). As many iterations as desired of steps 515 (e.g., or step 510) through 545 may be performed. If the user determines that use of apparatus 105 is not to be continued, process 500 ends at step 550.

In at least some exemplary embodiments, the exemplary disclosed method may be for converting a wearable apparatus 105. The exemplary disclosed method may include supporting a body member (e.g., body member 205) of the wearable apparatus from a shoulder of a user based on a shoulder connector (e.g., shoulder connector 210) of the wearable apparatus being directly attached to the body member and being supported at the shoulder of the user. The exemplary disclosed method may also include indirectly supporting a housing (e.g., housing 400) of the wearable apparatus based on removably attaching a housing cover of the housing to a housing body of the housing when the body member is received in a housing cavity of the housing body. The exemplary disclosed method may further include removing the housing from the wearable apparatus based on detaching the housing cover from the housing body. The exemplary disclosed method may also include moving the body member toward the shoulder of the user, when the shoulder connector is supported at the shoulder of the user, based on decreasing a length of the shoulder connector.

In at least some exemplary embodiments, the exemplary disclosed wearable apparatus (e.g., apparatus 105) may include a body member (e.g., body member 205), a shoulder connector (e.g., shoulder connector 210) directly attachable to the body member, the shoulder connector configured to be supported at a shoulder of a user, and a housing (e.g., housing 400) including a housing body, which forms a housing cavity, and a housing cover. The housing may be configured to be indirectly supported by the body member based on removably attaching the housing cover to the housing body when the body member is received in the housing cavity, the housing being configured to be removed from the wearable apparatus based on detaching the housing cover from the housing body. The shoulder connector may include a quick adjustment device (e.g., adjustment device 240) configured to decrease a length of the shoulder connector and move the body member toward the shoulder of the user when the shoulder connector is supported at the shoulder of the user. A direct attachment portion (e.g., direct attachment portion 201) directly attaching the shoulder connector to the body member may be configured to pass through a housing gap formed between the housing cover and the housing body without directly attaching to the housing when the body member is received in the housing cavity.

The invention includes other illustrative embodiments ("Embodiments") as follows.

Embodiment 1: A method for converting a wearable apparatus, comprising: supporting a body member of the wearable apparatus from a shoulder of a user based on a shoulder connector of the wearable apparatus being directly attached to the body member and being supported at the shoulder of the user; indirectly supporting a housing of the wearable apparatus based on removably attaching a housing cover of the housing to a housing body of the housing when the body member is received in a housing cavity of the housing body; removing the housing from the wearable apparatus based on detaching the housing cover from the housing body; and moving the body member toward the shoulder of the user, when the shoulder connector is supported at the shoulder of the user, based on decreasing a length of the shoulder connector.

Embodiment 2: The method of Embodiment 1, wherein a direct attachment portion directly attaching the shoulder connector to the body member passes through a housing gap formed between the housing cover and the housing body when the body member is received in the housing cavity and the housing cover is attached to the housing body Embodiment 3: The method of Embodiment 1, further comprising receiving a waist connector that is directly attached to the body member in the housing cavity when the body member is received in the housing cavity.

Embodiment 4: The method of Embodiment 3, further comprising maintaining the body member at the chest of the user based on decreasing the length of the shoulder connector and fastening the waist connector about the waist of the user.

Embodiment 5: The method of Embodiment 4, further comprising moving the body member to at least one of the side of the user or the back of the user based on rotating the body member, the waist connector, and the shoulder connector relative to the user.

Embodiment 6: The method of Embodiment 1, wherein a ballistic shield is disposed in a pocket of the body member.

Embodiment 7: The method of Embodiment 1, further comprising removably attaching one or more equipment items to one or more equipment connectors of the body member and receiving the one or more attached equipment items in the housing cavity when the body member is received in the housing cavity.

Embodiment 8: The method of Embodiment 1, further comprising wearing the wearable apparatus in an undeployed state in which the wearable apparatus outwardly appears as a shoulder bag when the body member is received in the housing cavity, the housing cover is removably attached to the housing body, and before the length of the shoulder connector is decreased.

Embodiment 9: The method of Embodiment 1, further comprising wearing the wearable apparatus in a deployed state in which the body member includes attached self-defense equipment items that are visible when the housing is removed from the wearable apparatus and the length of the shoulder connector is decreased.

Embodiment 10: The method of Embodiment 1, further comprising removing the housing from the wearable apparatus based on pulling the housing off of the body member and dropping the housing to the ground after detaching the housing cover from the housing body.

Embodiment 11: A wearable apparatus, comprising: a body member; a shoulder connector directly attachable to the body member, the shoulder connector configured to be supported at a shoulder of a user; and a housing including a housing body, which forms a housing cavity, and a housing cover, the housing configured to be indirectly supported by the body member based on removably attaching the housing cover to the housing body when the body member is received in the housing cavity, the housing being configured to be removed from the wearable apparatus based on detaching the housing cover from the housing body; wherein the shoulder connector includes a quick adjustment device configured to decrease a length of the shoulder connector and move the body member toward the shoulder of the user when the shoulder connector is supported at the shoulder of the user.

Embodiment 12: The wearable apparatus of Embodiment 11, wherein a direct attachment portion directly attaching the shoulder connector to the body member is configured to pass through a housing gap formed between the housing cover and the housing body without directly attaching to the housing when the body member is received in the housing cavity.

Embodiment 13: The wearable apparatus of Embodiment 11, further comprising a waist connector directly attachable to the body member and configured to be received in the housing cavity when the body member is received in the housing cavity.

Embodiment 14: The wearable apparatus of Embodiment 11, further comprising a ballistic shield configured to be disposed in a pocket of the body member.

Embodiment 15: The wearable apparatus of Embodiment 11, further comprising one or more non-operable faux fasteners attached to the housing, in addition to a release device attached to the housing that is configured to removably attach the housing cover to the housing body.

Embodiment 16: The wearable apparatus of Embodiment 15, wherein the release device includes a side release buckle, a snap button, magnetic connectors, or hook and loop fastener components.

Embodiment 17: The wearable apparatus of Embodiment 11, further comprising a MOLLE attachment grid disposed at the body member.

Embodiment 18: The wearable apparatus of Embodiment 11, wherein the quick adjustment device is a cinch strap handle, a cam buckle, or a ratchet strap buckle.

Embodiment 19: A wearable apparatus, comprising: a body member including a ballistic shield; a shoulder connector directly attachable to the body member, the shoulder connector configured to be supported at a shoulder of a user; and a housing including a housing body, which forms a housing cavity, and a housing cover, the housing configured to be indirectly supported by the body member based on removably attaching the housing cover to the housing body when the body member is received in the housing cavity, the housing being configured to be removed from the wearable apparatus based on detaching the housing cover from the housing body; wherein the shoulder connector includes a quick adjustment device configured to decrease a length of the shoulder connector and move the body member toward the shoulder of the user when the shoulder connector is supported at the shoulder of the user; and wherein a direct attachment portion directly attaching the shoulder connector to the body member is configured to pass through a housing gap formed between the housing cover and the housing body without directly attaching to the housing when the body member is received in the housing cavity.

Embodiment 20: The wearable apparatus of Embodiment 19, wherein the quick adjustment device includes a cinch strap with a D-ring pull handle.

In at least some exemplary embodiments, the exemplary disclosed system, apparatus, and method may provide an efficient and effective system for self-defense. The exemplary disclosed system, apparatus, and method may provide an efficient and effective system for quickly and easily deploying a wearable apparatus such as a defensive accessory from an undeployed state to a fully deployed state for use in self-defense. For example, the exemplary disclosed system, apparatus, and method may provide an efficient and effective system for quickly and easily deploying a wearable apparatus (e.g., defensive accessory) from an undeployed state, which may appear to be an inconspicuous item such as a bag, to a fully deployed state for use in self-defense.

It will be apparent to those skilled in the art that various modifications and variations can be made to the exemplary disclosed system, apparatus, and method. Other embodiments will be apparent to those skilled in the art from consideration of the specification and practice of the exemplary disclosed apparatus, system, and method. It is intended that the specification and examples be considered as exemplary, with a true scope being indicated by the following claims.

What is claimed is:

1. A method for converting a wearable apparatus, comprising:

supporting a body member of the wearable apparatus from a shoulder of a user based on a shoulder connector of the wearable apparatus being directly attached to the body member and being supported at the shoulder of the user;

indirectly supporting a housing of the wearable apparatus based on removably attaching a housing cover of the housing to a housing body of the housing, by removably attaching a first release device component attached to the housing cover to a second release device component attached to the housing body, when the body member is received in a housing cavity formed by the housing body;

removing the housing from the wearable apparatus by detaching the first release device component from the second release device component so that the housing cover, which substantially covers the housing cavity, opens from the housing body and the housing falls from the body member; and moving the body member toward the shoulder of the user, when the shoulder connector is supported at the shoulder of the user, based on decreasing a length of the shoulder connector.

2. The method of claim 1, wherein a direct attachment portion directly attaching the shoulder connector to the body member passes through a housing gap formed between the housing cover and the housing body when the body member is received in the housing cavity and the housing cover is attached to the housing body.

3. The method of claim 1, further comprising receiving a waist connector that is directly attached to the body member in the housing cavity when the body member is received in the housing cavity.

4. The method of claim 3, further comprising maintaining the body member at the chest of the user based on decreasing the length of the shoulder connector and fastening the waist connector about the waist of the user.

5. The method of claim 4, further comprising moving the body member to at least one of the side of the user or the back of the user based on rotating the body member, the waist connector, and the shoulder connector relative to the user.

6. The method of claim 1, wherein a ballistic shield is disposed in a pocket of the body member.

7. The method of claim 1, further comprising removably attaching one or more equipment items to one or more equipment connectors of the body member and receiving the one or more attached equipment items in the housing cavity when the body member is received in the housing cavity.

8. The method of claim 1, further comprising wearing the wearable apparatus in an undeployed state in which the wearable apparatus outwardly appears as a shoulder bag when the body member is received in the housing cavity, the housing cover is removably attached to the housing body, and before the length of the shoulder connector is decreased.

9. The method of claim 1, further comprising wearing the wearable apparatus in a deployed state in which the body member includes attached self-defense equipment items that are visible when the housing is removed from the wearable apparatus and the length of the shoulder connector is decreased.

10. The method of claim 1, further comprising removing the housing from the wearable apparatus based on pulling the housing off of the body member and dropping the housing to the ground after detaching the housing cover from the housing body.

11. A wearable apparatus, comprising:

a body member;

a shoulder connector directly attached to the body member, the shoulder connector configured to be supported at a shoulder of a user; and a housing including a housing body, which forms a housing cavity, and a housing cover, the housing indirectly supported by the body member with the housing cover removably attached to the housing body, with the body member received in the housing cavity, the housing being configured to be removed from the wearable apparatus based on detaching the housing cover from the housing body so that the housing cover opens from the housing body and the housing falls from the body member;

wherein the shoulder connector includes a quick adjustment device configured to decrease a length of the shoulder connector and move the body member toward the shoulder of the user when the shoulder connector is supported at the shoulder of the user; and wherein the shoulder connector and the body member are only attached to the housing by the shoulder connector passing through a housing gap formed between the housing cover and the housing body.

12. The wearable apparatus of claim 11, wherein a direct attachment portion directly attaching the shoulder connector to the body member is configured to pass through the housing gap formed between the housing cover and the housing body without the direct attachment portion attaching to the housing when the body member is received in the housing cavity.

13. The wearable apparatus of claim 11, further comprising a waist connector directly attachable to the body member and configured to be received in the housing cavity when the body member is received in the housing cavity.

14. The wearable apparatus of claim 11, further comprising a ballistic shield configured to be disposed in a pocket of the body member.

15. The wearable apparatus of claim 11, further comprising one or more non-operable faux fasteners attached to the housing, in addition to a release device attached to the housing that is configured to removably attach the housing cover to the housing body.

16. The wearable apparatus of claim 15, wherein the release device includes a side release buckle, a snap button, magnetic connectors, or hook and loop fastener components.

17. The wearable apparatus of claim 11, further comprising a MOLLE attachment grid disposed at the body member.

18. The wearable apparatus of claim 11, wherein the quick adjustment device is a cinch strap handle, a cam buckle, or a ratchet strap buckle.

19. A wearable apparatus, comprising:

a body member including a ballistic shield;

a shoulder connector directly attached to the body member, the shoulder connector configured to be supported at a shoulder of a user; and a housing including a housing body, which forms a housing cavity, and a housing cover, the housing indirectly supported by the body member with the housing cover removably attached to the housing body, with the body member received in the housing cavity, the housing being configured to be removed from the wearable apparatus based on detaching the housing cover from the housing body so that the housing cover opens from the housing body and the housing falls from the body member;

wherein the shoulder connector includes a quick adjustment device configured to decrease a length of the shoulder connector and move the body member toward the shoulder of the user when the shoulder connector is supported at the shoulder of the user;

wherein the shoulder connector and the body member are only attached to the housing by the shoulder connector passing through a housing gap formed between the housing cover and the housing body; and wherein a direct attachment portion directly attaching the shoulder connector to the body member is configured to pass through the housing gap formed between the housing cover and the housing body without the direct attachment portion attaching to the housing when the body member is received in the housing cavity.

20. The wearable apparatus of claim 19, wherein the quick adjustment device includes a cinch strap with a D-ring pull handle.

* * * * *